United States Patent [19]

Robinson et al.

[11] 4,197,724

[45] Apr. 15, 1980

[54] KNITTING METHOD

[75] Inventors: Frank Robinson; Nigel S. Whatmough, both of Breaston, England

[73] Assignee: Courtaulds Limited, London, England

[21] Appl. No.: 946,727

[22] Filed: Sep. 28, 1978

[30] Foreign Application Priority Data

Oct. 4, 1977 [GB] United Kingdom ..... 41160/77

[51] Int. Cl.[2] ..... A41B 9/06

[52] U.S. Cl. ..... 66/176

[58] Field of Search ..... 66/175, 176

[56] References Cited

U.S. PATENT DOCUMENTS

| | | | |
|---|---|---|---|
| 3,635,051 | 1/1972 | Betts et al. | 66/176 |
| 3,636,733 | 1/1972 | Betts et al. | 66/176 |
| 3,640,097 | 2/1972 | Betts et al. | 66/176 |
| 4,095,441 | 6/1978 | Robinson et al. | 66/176 |

*Primary Examiner*—Ronald Feldbaum

*Attorney, Agent, or Firm*—Davis, Hoxie, Faithfull & Hapgood

[57] ABSTRACT

A method of knitting a blank for a sleeved garment on a knitting machine comprises the steps, not necessarily in the order specified, of knitting fabric for one sleeve and for an associated sleeve shoulder portion of a yoke for the garment, in which knitted courses extend lengthwise of the sleeve fabric and through the associated sleeve shoulder portion towards the neck of the garment, knitting front and rear body fabrics and associated front and rear body shoulder portions of the yoke, in which knitted courses extend in the waist-neck direction in the body fabrics and continue towards the garment neck through the body shoulder portions, and knitting fabric for the other sleeve of the garment and for an associated sleeve shoulder portion of the garment yoke, in which knitted courses extend lengthwise of the sleeve fabric and through the associated sleeve shoulder portion towards the garment neck, whereby the garment yoke comprises front and rear fabrics, each of which comprises a body shoulder portion and a part of each of the two sleeve shoulder portions, and in which wales extend in the direction around the yoke and the yoke is shaped by knitting some courses shorter than the longest courses so that the shorter courses do not extend to the neck of the garment.

6 Claims, 10 Drawing Figures

KNITTING METHOD

Figure 1:
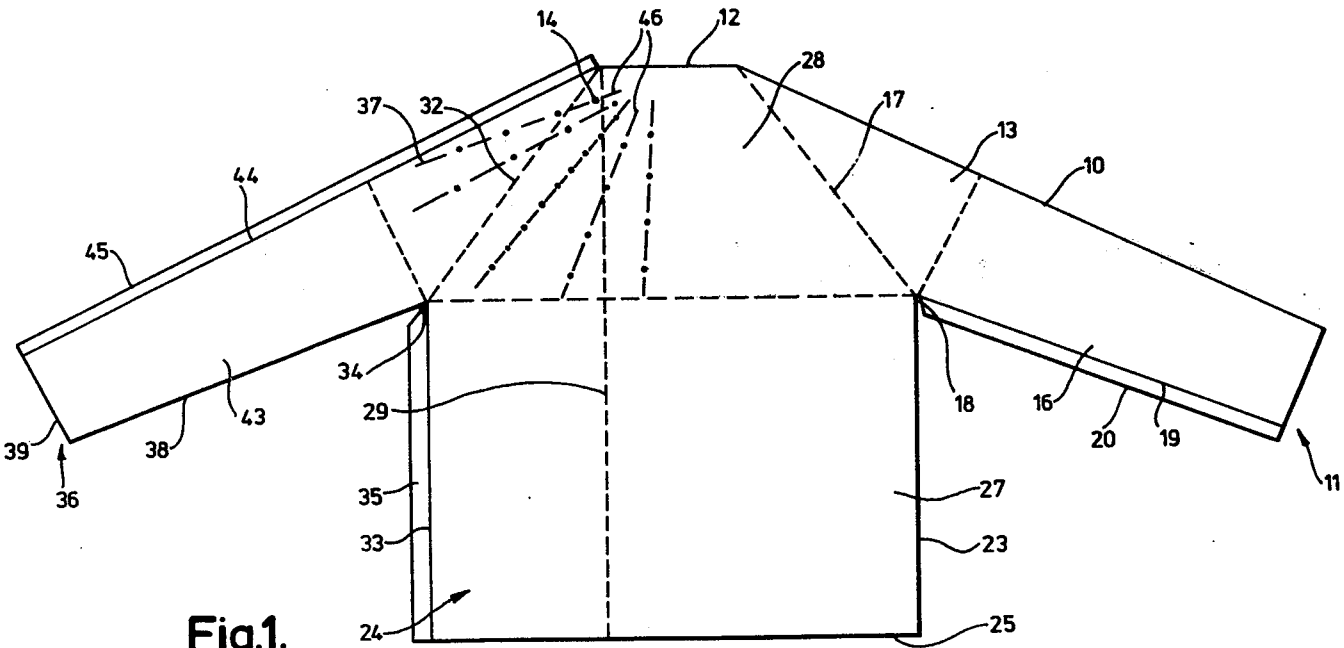

This invention relates to the production of knitted garments.

Using hitherto conventional production methods, a knitted garment has been made by knitting separate panels constituting sleeves, body parts and trimmings for the garment and subsequently sewing these separate panels together. More recent proposals for producing knitted garments involve knitting blanks comprising all or a substantial number of the garment panels already joined to one another in the knitting process.

According to some of these proposals, some of the inter-panel joins may need to be completed on a sewing machine after removal of the blank from the knitting machine.

The present invention aims to provide a production method for knitted garments in which at least some of the inter-panel joins are completed during the knitting process and which affords opportunities for shaping the upper part of the garment and for altering the angle of inclination of the sleeves.

According to the invention, a method of knitting a sleeved garment or garment blank on a knitting machine comprises the steps of knitting fabric for one sleeve and for an associated sleeve shoulder portion of a yoke for the garment, wherein knitted courses extend lengthwise of the sleeve fabric and through the associated sleeve shoulder portion towards the neck of the garment, knitting front and rear body fabrics and associated front and rear body shoulder portions of the yoke, wherein knitted courses extend in the waist-neck direction in the body fabrics and continue towards the garment neck through the body shoulder portions, and knitting fabric for the other sleeve of the garment and for an associated sleeve shoulder portion of the garment yoke, wherein knitted courses extend lengthwise of the sleeve fabric and through the associated sleeve shoulder portion towards the garment neck, whereby the garment yoke comprises front and rear fabrics, each of said fabrics comprising a body shoulder portion and a part of each of said sleeve shoulder portions, and wherein wales extend in the direction around the yoke and the yoke is shaped by knitting some courses shorter than the longest courses so that the shorter courses do not extend to the neck of the garment.

Loops of an initial course of the yoke may be joined, on the knitting machine, with a final course of the yoke so that the garment or blank falls from the knitting machine having a conical or frusto-conical piece of yoke fabric.

The method of the invention may be carried out by commencing knitting along the outer edge of a sleeve and knitting on two needle beds to form on each needle bed a part of said sleeve and part of a shoulder portion associated with said sleeve, continuing knitting on said two needle beds to form on each needle bed part of the body fabric of the garment and a body shoulder portion associated with said body fabric, and further continuing knitting on said two needle beds to form on each needle bed a part of the second sleeve of the garment and part of a shoulder portion associated with said second sleeve.

The method of the invention may also be carried out by knitting, on needles of one needle bed, a first sleeve and an associated sleeve shoulder portion of the garment, knitting on needles of each of two needle beds a distinct part of the body fabric of the garment and a distinct part of a body shoulder portion associated with said distinct part of the body fabric, and subsequently knitting on needles of one bed a second sleeve and an associated sleeve shoulder portion.

Further, the method of the invention may be carried out by knitting a first sleeve and an associated sleeve shoulder portion of the garment, forming at the cuff of the sleeve an area of rib fabric on two needle beds, then knitting a body part of the garment and an associated body shoulder portion integral with said sleeve shoulder portion, said body part having adjacent the waist line of the garment an area of rib fabric knitted on two needle beds, knitting a second body part of the garment and an associated body shoulder portion integral with said sleeve shoulder portion, said second body part having adjacent the waist line of the garment an area of rib fabric knitted on two needle beds, and knitting a second sleeve and an associated sleeve shoulder portion of the garment and forming at the cuff of the sleeve an area of rib fabric on two needle beds.

Again, the method of the invention may be carried out by commencing knitting with opposed rows of loops on opposed sets of loop handling elements, said rows of loops extending from the waist into a shoulder portion of the garment, holding loops of one of said rows in said shoulder portion on the associated set of elements and knitting on the opposed set of elements a sleeve and an associated sleeve shoulder portion of the garment, a body part of the garment and an associated body shoulder portion, a second sleeve and associated sleeve shoulder portion, and a second body part and associated body shoulder portion, the body and sleeve shoulder portions being knitted integral with and in continuation of one another and operating said opposed sets of loop handling elements to join the final part of the last garment shoulder portion to the initial row of held shoulder portion loops.

Figure 2:
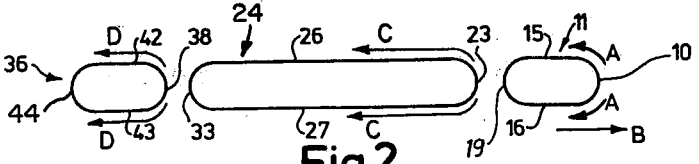
Figure 3:
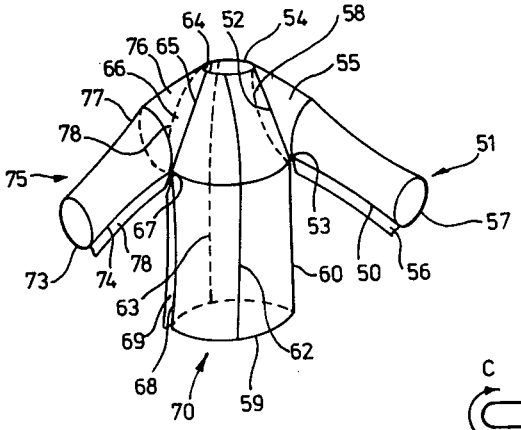
Figure 4:
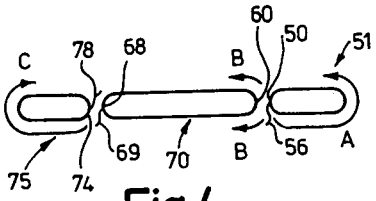
Figure 9:
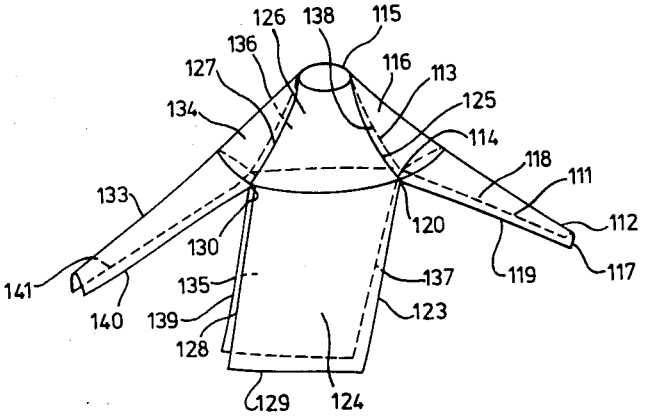
Figure 10:
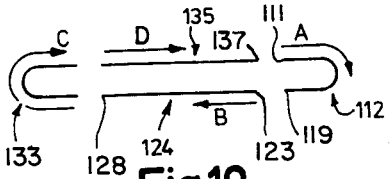
Figure 5:
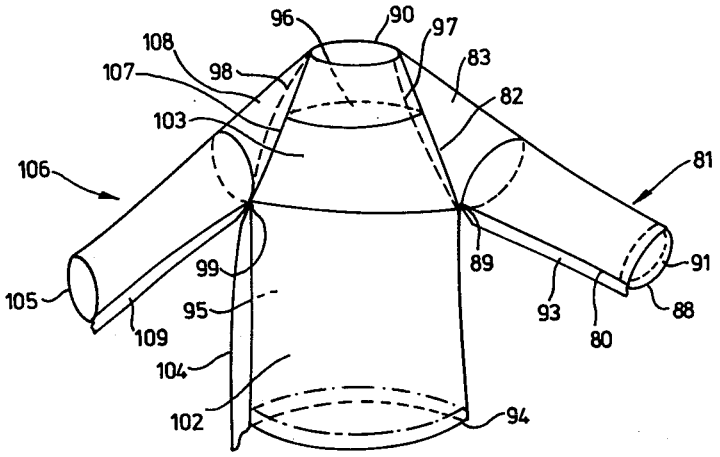
Figure 6:
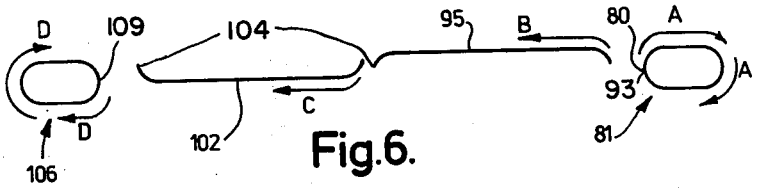
Figure 7:
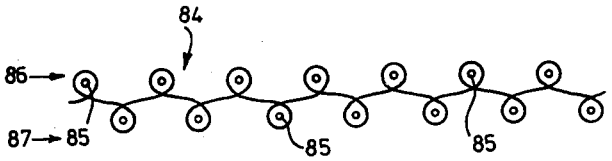
Figure 8:
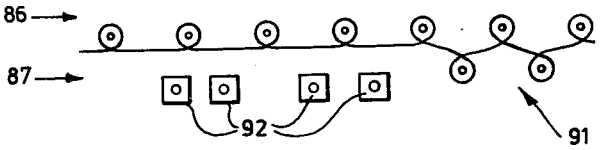

The invention will be further described, by way of example, with reference to the accompanying drawings in which:

FIG. 1 illustrates the knitting of a sleeved garment according to the present invention, FIG. 2 shows diagrammatically the direction of knitting in the sleeves and body of the garment of FIG. 1, FIG. 3 is a diagrammatic representation of another garment according to the present invention and illustrates the method of knitting the garment, FIG. 4 shows diagrammatically the direction of knitting in the sleeves and body of the garment of FIG. 3, FIG. 5 is a diagrammatic representation of another garment according to the present invention and illustrates the method of knitting the garment, FIG. 6 shows diagrammatically the direction of knitting in the sleeves and body of the garment of FIG. 5, FIGS. 7 and 8 illustrate diagrammatically the stitch formations of two knitted courses of the garment of FIG. 5, FIG. 9 is a diagrammatic representation of another garment according to the present invention and illustrates the method of knitting the garment, and FIG. 10 shows diagrammatically the direction of knitting in the sleeves and body of the garment of FIG. 9.

The knitting methods described below may be carried out on a knitting machine having two opposed needle beds, individually operable needles and means for pushing down the fabric which allows knitting to be carried out on some needles whilst other adjacent needles are inactive but hold loops of the knitted fabric.

Such means serve in place of conventional take-down rollers and may be as described in British Patent Specification No. 1,288,043 (Courtaulds Limited). A commercially available knitting machine which can be used to carry out the methods described and which incorporates a mechanism similar to that described in British Patent Specification No. 1,288,043 is the machine designated JDRPM manufactured by Edouard Dubied & Cie of Neuchatel, Switzerland.

Some of the methods described below require a garment to be knitted on one bed of a knitting machine only, needles of the other bed in a machine with two opposed beds being used only to hold loops whilst needles of the opposite bed knit. Such methods can also be carried out on a knitting machine having a single needle bed and a set of loop-holding elements capable of co-operating with the needles of that bed.

Further, some of the methods described below include a procedure in which some needles of a needle bed are operated to knit whilst intermediate needles of the same bed hold previously formed loops of the knitted fabric without knitting. To carry out these methods it is necessary to employ a knitting machine capable of operating its needles in this way. An example of such a machine is the JDRPM machine mentioned above.

The knitting of the garment blank illustrated in FIG. 1 is begun at an outer edge 10 of a sleeve 11 by knitting a 1×1 rib course employing both beds of the knitting machine. However, the 1×1 rib course extends not only along the length of the sleeve 11 but up to the neck 12 of the garment along the outer edge (10) of a sleeve shoulder portion 13 of a yoke 14 of the blank.

After the formation of the edge 10, knitting is continued on both needle beds of the knitting machine to produce a separate piece 15 or 16 of single jersey fabric on each needle bed, the two fabric pieces 15 and 16 nevertheless being joined to one another along the edge 10. Each of the fabric pieces 15, 16 has a part constituting part of the fabric of the sleeve 11 and a part constituting part of the sleeve shoulder portion 13, and knitted courses extend lengthwise of the sleeve 11 in each of the two fabric pieces 15 and 16 and through the shoulder portion 13 in the general direction towards the neck 12 of the garment. Arrows A in FIG. 2 show the direction of knitting of the front and rear fabric pieces (15 and 16) of the sleeve 11 and shoulder portion 13 and arrow B in FIG. 2 shows the direction in which these fabrics fall way from the beds of the knitting machine. In FIG. 2 the courses of the knitting in each of the fabric pieces 15, 16, 26, 27, 42 and 43 are disposed perpendicular to the plane of the paper.

During the knitting of the sleeve 11 and shoulder portion 13, the courses of knitting are made successively shorter than the original rib course at the edge 10. The needles taken out of action retain their loops. The upper ends of the courses of the piece of fabric 16 lie along the broken line 17 in FIG. 1. The upper ends of the courses of the fabric 15 lie along a similar line in the back of the garment. The last courses of the sleeve 11 extend only to an armpit 18 of the garment without entering the shoulder portion 13. When these last courses in the fabric pieces 15 and 16 have been knitted, a 1×1 rib course is knitted along the underarm line 19 of the sleeve 11 to join the two fabric pieces together. This rib course is followed by a few more rib courses 20 to prevent the knitting from unroving and opening up the join after press-off and then the last of these rib courses is pressed off the needles.

Knitting is now recommenced along the side edge 23 of the garment body 24 using a 1×1 rib course which extends from the waist 25 of the garment to the armpit 18. Thereafter knitting is continued on both needle beds to produce a separate single jersey fabric 26 or 27 on each needle bed, the two fabrics being joined to one another along the edge 23. The arrows C in FIG. 2 show the direction of knitting of the fabrics 26, 27.

The courses of the fabrics 26 and 27 extend in the general direction of the neck 12. the courses are made successively longer so that the courses after the first rib course (along edge 23) extend into front and rear body shoulder portions of the garment yoke 14. Only one of the body shoulder portions (28) is visible in FIG. 1. As the courses of fabrics 26 and 27 are lengthened, needles taken out of action in knitting fabrics 15 and 16 are brought back into action and the end loops of the courses of the fabrics 16 and 27 are knitted through held loops of fabrics 15 and 16, respectively. The upper ends of the courses of the fabric 27 lie in the line 17 and the upper ends of the courses of the fabric 26 lie in the corresponding line at the back of the garment mentioned above.

When courses of fabrics 26 and 27 reach the neck 12 of the garment, knitting of both fabrics is continued with courses of this length until the course 29 in each fabric is reached marking the end of the neck. Thereafter, the courses of fabrics 26 and 27 are made successively shorter, the upper ends of the courses of the fabric 27 lying along the line 32 in FIG. 1 and the upper ends of the courses of fabric 26 lying along a corresponding line at the back of the garment. The needles taken out of action to reduce the length of the courses retain their loops of yarn.

When the final course 33 of this part of the garment is reached, extending only from the waist 25 to the armpit 34, it is knitted as a 1×1 rib course joining the fabrics on the two needle beds. A few more courses 35 of rib fabric are knitted to reduce risk of run-back and the final course 35 is then pressed off the needles.

Knitting of the sleeve 36 and the final portion 37 of the yoke 14 is begun with a 1×1 rib course along the edge 38 of the sleeve and extending from the cuff 39 to the armpit 34.

After formation of the edge 38, knitting is continued on both needle beds of the knitting machine to produce a separate single jersey fabric 42 or 43 on each needle bed. Each of the fabrics 42,43 has a part constituting part of the sleeve shoulder portion 37. Knitted courses extend lengthwise of the sleeve 36 in each of the two fabrics 42 and 43 and through the shoulder portion 37 in the general direction of the neck 12 of the garment. The direction of knitting in fabrics 42 and 43 is shown by the arrows D in FIG. 2.

During the knitting of the sleeve 36 and shoulder portion 37, the courses of knitting are made successively longer so that although the first rib course of the sleeve 36 along the edge 38 does not extend into the portion 37, subsequent courses of the separate fabrics 42 and 43 do extend into this portion. As the courses of the sleeve 36 are lengthened, needles taken out of action during knitting of the fabrics 26 and 27 are brought back into action and the end loops of the courses of the fabrics 42 and 43 are knitted through held loops of fabrics 26 and 27, respectively. The upper ends of the courses of the fabric 43 lie in the line 32 and the upper ends of the courses of the fabric 42 lie in the corresponding line at the back of the garment.

When courses of the fabrics 42 and 43 reach the neck 12 of the garment, knitting of both fabrics is continued with a 1×1 rib course 44 and then a series of rib courses 45 before pressing the garment off the needles.

Alternatively, the loops on one needle bed may be transferred to needles holding loops on the opposite needle bed after which a few courses of single jersey knitting can be formed to complete the closure.

To complete the garment, the neck opening is enlarged, if desired, and a trimming is secured round it. The pieces of rib knitting 20, 35 and 45 are seamed close to the courses 19, 33 and 44, respectively, and the excess courses are cut off. Alternatively, a linking technique may be used to secure the fabrics 15, 16; 26, 27; and 42, 43 together along the edges 19, 33 and 44, respectively, the rib course being then cut away. The garment may be turned inside out for wearing.

In order to provide further shaping features in the garment, instead of forming sleeve-body style lines 17 and 32 by taking needles out of action progressively and then bringing them back into action, a number of suture lines 46 can be formed in the yoke 14 by taking needles out of action group by group whilst retaining the loops on the needles and then bringing those needles back into operation again collectively. There may be a small number of needles, for example four to ten, in each group. Alternatively, the needles along one or more of the lines 46 can be taken out of action collectively and brought back into action group by group.

It is also possible to take the needles out of action as well as bring them back into action group by group along the lines 46.

The presence of suture lines 46 at front and back of the garment gives the yoke 14 a conical shape which fits the shoulder region of the body well.

A further manner of describing three alternative ways of forming each of the suture lines 17, 32 and 46 is as follows:

(1) a gradual decrease from the full knitting width takes place by controlled reduction of course lengths followed by a full width needle reintroduction;

(2) a sudden needle reduction from full width knitting to the shortest course length is followed by a gradual increase in course length until the full width is reached again; and (3) gradual decrease of course length from full knitting width to the shortest course is followed by a gradual increase again to full width.

A further variation of the procedure for knitting some courses shorter than others to shape the article is to knit some spaced-apart long courses having the same or substantially the same length which will be the longest course length found in the particular part of the garment concerned. Interspersed amongst these long courses are shorter courses of different lengths. For example, the long courses may be alternate courses and the shorter courses may be distributed one between each pair of long courses and may increase within one series of shorter courses steadily in length, from a very short course to one almost as long as a long course before the next series of shorter courses begins with another very short course. Other patterns of shorter and long course distribution are possible on the lines outlined above, for example, the shorter courses may steadily increase in length and then steadily decrease in length. The long courses may be arranged in spaced-apart pairs or groups as may the shorter courses.

A feature of the garment of FIGS. 1 and 2 when the edges 19, 33 and 44 are not linked is that along the outer edge 10 of the sleeve 11 there is no seam but along the outer edge 44 of the other sleeve 36 there will be a sewing seam or other structure which locks the rib courses against unroving. In practice, the difference between the two sleeves will normally be unnoticeable, or virtually so, but if desired, the sequence of knitting can be changed to ensure that seams are located on the underside in both sleeves. A method of achieving a garment according to the invention with this feature is illustrated in FIGS. 3 and 4.

In the method of FIGS. 3 and 4, knitting is begun by forming a 1×1 rib course on the two needle beds extending along the underarm line 50 of a sleeve 51 and along a line 52 corresponding to a raglan style line at the front of the garment and extending from an armpit 53 to the neck 54 of the garment. After the formation of this rib course, knitting is halted on one needle bed and single jersey knitting is continued on the other needle bed to form in the direction of the arrow A in FIG. 4 enough fabric to constitute the sleeve 51 and an associated sleeve shoulder portion 55 extending to front and back of the garment. The direction of knitting of this piece of fabric is indicated by the arrow A in FIG. 4, and in this Figure the courses of the various knitted fabrics are disposed perpendicular to the plane of the paper. In order to obtain the raglan shaping in the shoulder portion and to shape the sleeve 51, courses of different lengths are knitted, needles taken out of action to achieve this being operated to retain their last-formed loops. Shaping of the shoulder portion 55 is achieved by knitting immediately after the initial rib course 50, a course on one needle bed which extends from the sleeve cuff 57 only to the armpit 53 and thereafter increasing the course length progressively so that the ends of the courses lie along the line 52. When the neck 54 is reached, the courses of knitting are gradually reduced in length along a line 58 constituting a raglan style line at the back of the garment. The increase and decrease of course length may take place in successive courses or by groups of courses.

When the sleeve 51 and shoulder portion 55 have been knitted, a 1×1 rib course, again along the edge 50 extending from the cuff 57 to the armpit 53, is knitted to join the edges of the sleeve fabric along this underarm edge of the sleeve. A few further rib courses 56 knitted prior to pressing off the knitting between cuff 57 and armpit 53 ensure that after press-off the knitting will not unrove into the sleeve fabric.

When the last rib course 56 has been pressed off the needles, a new 1×1 rib course 60 is knitted to extend from the waist 59 of the garment to the armpit 53, the end stitches of this course on the two needle beds joining with end stitches in the lines 52 and 58 also lying in the armpit 53. Thereafter, a single jersey knitting is continued, in the directions of the arrows B in FIG. 4, to form separate fabrics on the two needle beds each fabric comprising part of the body of the garment and an associated body shoulder portion. One of these fabrics is in continuation of the loops extending on one needle bed from the waist 59 to the armpit 53 and to the neck 54 along the line 52 and the other fabric is in continuation of the loops extending on the other needle bed from the waist 59 to the armpit 53 and to the neck 54 along the line 58. The initial courses of these fabrics extend only to the armpit 53 and the courses are then gradually increased in length so that the upper ends of the courses in FIG. 3 lie along the lines 52 and 58, inactive needles holding loops of the sleeve shoulder region 55 located in these lines being brought back into action progressively to achieve this.

When the courses in the two fabrics extend to the neck 54 of the garment, a number of courses 62 and 63 of this length are knitted until the point 64 of the neck is reached and the length of the courses is then progressively reduced by taking out of action needles holding end loops of the courses lying in lines 65 and 66 in the garment. These needles retain their last-formed loops. When the armpit 67 is reached a 1×1 rib course is formed along the side edge 68 of the body 70 of the garment and a few further courses 69 of rib knitting are formed at this edge to prevent unroving of the knitting when the last of these courses is pressed off the needles.

After this pressing-off, a 1×1 rib course is knitted extending from the cuff 73 to the armpit 67 along the edge 74 of the sleeve 75. Thereafter knitting is continued, in the direction of the arrow C in FIG. 4, only on the needle bed carrying loops of the front fabrics of the garment to knit the sleeve 75 and an associated sleeve shoulder portion. The initial course of this further single jersey knitting extends only from the cuff 73 to the armpit 67 in the sleeve 75 but following courses are increased progressively in length so as to extend into the sleeve shoulder portion 76 associated with the sleeve 75. Ends of the courses lie in the line 65 and needles holding loops of the body fabric lying along this line are progressively reintroduced to knitting action as the knitting continues. When the longest course 77 of the sleeve 75 and its shoulder portion 76 have been knitted, knitting continues on the same needle bed but the courses are progressively reduced in length so that ends of the courses lie along a raglan style line 66 at the rear of the garment. On completion of the sleeve fabric, a 1×1 rib course is knitted extending from the cuff 73 along the edge 74, through the armpit 67 and along the line 66 to the neck 54. Along the edge 74, this rib course joins together the front and rear fabrics of the sleeve 75 and along the line 66 it joins together the fabric of the sleeve shoulder portion on the front needle bed with the loops of the rear body fabric lying along the line 66 on needles of the rear needle bed. A few further rib courses 78 are knitted and then the garment is pressed off the needles.

To complete a garment from the blank thus produced, the rib courses along the edges 50, 68 and 74 and along the line 66 are locked against unroving (for example by seaming on an overlock machine which cuts off the bulk of these courses at the same time). The garment may then be turned inside out, and the neck is finished to provide a desired shape of opening and a desired trim.

The shoulder portions in the blank of FIG. 3 can be shaped in the same way as the shoulder portions of the blank of FIGS. 1 and 2 by cyclically varying the lengths of the courses knitted at intervals during formation of the shoulder portions. Thus, the raglan style lines 52 and 65 and their counterparts at the rear of the garment can be eliminated and replaced by a number of style lines at intervals around the sleeve and body shoulder portions. The courses of varying length may be achieved, for example, by taking all the needles holding shoulder portion loops out of action en bloc and progressively reintroducing them, by progressively taking the needles out of action and reintroducing them en bloc or by taking them out of action progressively and reintroducing them progressively.

In order to make the garment of FIGS. 3 and 4 symmetrical so that the structure along the style line or join line 58 is the same as that along the line 66, knitting may be commenced along the line 58 (instead of along line 52 and edge 50) by forming a few rows of 1×1 rib knitting extending from the armpit 53 to the neck 54. Then a rib course extending from cuff 57 to neck 54 along edge 50 and line 58 is knitted and thereafter a knitting procedure similar to that described above in relation to FIGS. 3 and 4 is followed except that the direction of knitting round the sleeve 51 and in the arm shoulder region 55 is reversed. However, when the garment is pressed off the needles, rib courses are to be found along the line 58 as well as along the line 66, and when these courses are cut and seamed the style line 58 will have the same appearance as the style line 66.

Although a start and end to knitting along the outside edges of the sleeves (FIGS. 1 and 2) and along the inside edges of the sleeves (FIGS. 3 and 4) (and along corresponding lines in the shoulder regions) have been described above, it is possible to start and finish the sleeves at any point around their circumference.

FIGS. 5 to 8 illustrate the production of a garment according to the invention having waist and cuff trimmings integrally formed with the body and sleeve panels.

Knitting is begun along the edge 80 of a sleeve 81 and along a line 82 in a sleeve shoulder portion 83 of the garment by forming a first rib course 84, shown diagrammatically in FIG. 7 held on needles 85 of the two needle beds 86 and 87 of a V-flat knitting machine. The rib course 84 extends from the cuff 88 of the sleeve 81 through an armpit 89 to the neck 90 of the garment. FIGS. 7 and 8 are purely diagrammatic and the number of needles and knitted loops shown in those Figures is far smaller than would be found in an actual knitting machine or garment.

After knitting of the rib course 84, knitting of the sleeve 81 and the associated shoulder portion 83, is continued in the direction of the arrows A in FIG. 6, in which Figure the courses of the various knitted fabrics are disposed perpendicular to the plane of the paper. For the most part knitting takes place only on needles of the bed 86, forming at first loops of the rear fabric of the garment. However, at the cuff 88, knitting is continued, for the width of the cuff, on both needle beds 86 and 87 to form an area of rib fabric constituting a rib trimming 91 (FIG. 8). The other loops 92 on the needle bed 87 forming part of the course 84 are held on inactive needles for the moment. During knitting of the sleeve 81, and portion 83, courses of different lengths are knitted to shape the sleeve 81 and the shoulder region 83. This shaping may be achieved by knitting initially short courses up to the armpit 89 of the garment and progressively increasing the lengths of these courses unti courses extending to the neck 90 are achieved and thereafter progresssively decreasing the length of the courses once more until a course extending only to the armpit 89 is once more knitted. Thereupon the inactive needles holding the loops 92 are brought back into action to form, together with the needles of the needle bed 86, a number of courses of rib knitting 93 which extend only from the cuff to the arm pit. The last of the courses 93 is then cast off the needles.

When courses are progressively decreased in length in knitting the region 83, the needles made inactive are operated to retain their last knitted loops.

After the last course 93 has been cast off on completion of the sleeve 81 and portion 83, a course of rib knitting extending from the waist 94 to the armpit 89 is knitted. Thereafter knitting is continued on needles of both needle beds in the waist region of the garment to form a waist trimming, but over the greater length of the wasit-armpit line, the needles of the needle bed 87 are made inactive and retain their last formed loops whilst knitting continues on the needles of the needle bed 86 to produce, in the direction of the arrow B in FIG. 6, the rear body panel 95 of the garment extending from the waist 94 to the neck 90 and including a rear body part and a rear body shoulder portion 96.

During knitting of the panel 95, inactive needles holding loops along a sleeve-body line 97 marking the termination of the sleeve shoulder portion 83 are progressively brought back into action until the neck 90 is reached and then, after the tallest part of the panel 95 extending up to the neck 90 has been knitted, these needles are taken out of action again along the line 98 until a course extending only from the waist 94 to the armpit 99 is reached. Knitting on the rear bed 86 is then stopped and knitting is begun again on the front bed 87, in the direction of the arrow C in FIG. 6, on the needles holding loops extending from waist 94 to the armpit 89 and a front body panel 102 is formed including a front body part and a body shoulder portion 103. As knitting of the panel 102 progresses, inactive needles holding loops along the line 82 are progressively brought into action until the neck 90 is reached and these needles are later progressively taken out of action again to shorten the knitted courses so that on completion of the panel 102, the last course extends from armpit 99 to waist 94.

In order to produce a knitted seam along the line from the waist 94 to the armpit 99, a few courses of rib knitting 104 are formed along this line to join stitches of the front and rear panels togehter, before pressing off the knitting below the armpit 99.

To complete the garment, a course of rib knitting is now formed extending from the armpit 99 to the cuff 105 of a sleeve 106 for the garment. Thereafter, knitting is continued on the front needle bed 87 only, in the direction of the arrow D in FIG. 6, using progressively increasing course length so that inactive needles holding loops in the sleeve-body join line 107 are progressively brought back into action to form the sleeve shoulder portion 108.

After the longest courses of the portion 108 have been knitted extending to the neck 90, the course length is again diminished by taking needles out of action progressively so that the end loops of the courses formed lie along the line 98. Finally, when a course extending only to the armpit 99 is again reached, a few courses of rib knitting 109 are formed extending from the cuff 105 to the neck 90 to join together the loops held on the front and rear needle beds. These loops lie along the inner edge of the arm 106 up to the armpit 99 and along the line 98 at an edge of the fabric of the body shoulder region 96 and along the corresponding line 98 at an edge of the sleeve shoulder portion 108.

When the blank has been pressed off the needles of the knitting machine, the rib courses 93, 104 and 109 are prevented from unroving by trimming and seaming. When the neck opening has been shaped and trimmed the blank can be turned inside out to produce a completed garment.

In the method of FIGS. 9 and 10, knitting is begun on two opposed rows of loop-handling elements. Conveniently, these elements may be the needles of opposed needle beds of a V-bed machine but they may be constituted by a row of knitting elements and a row of loop-holding points since, in this method, knitting need only be carried out on one bed of needles. Knitting may be commenced at any point around the garment but in FIGS. 9 and 10 it is shown as commencing along the underarm line 111 of a sleeve 112 and a style line 113 extending from an armpit point 114 of the garment to the neck 115 of the garment. After the initial course formed on opposed rows of elements, knitting is continued on one of the rows of elements only, the elements of the other row being operated to retain the loops which have been formed on them. Fabric constituting the sleeve 112 and the associated shoulder portion 116 of the garment are now formed in the direction of the arrow A in FIG. 10, in which Figure the courses of the various knitted fabrics are disposed perpendicular to the plane of the paper. Knitted courses extend lengthwise of the fabric of the sleeve 112 and through the portion 116 towards the neck 115 and some of the courses are made shorter than others so that they do not extend completely to the neck, thereby shaping the yoke (or shoulder region of the garment) of which the portion 116 is a part. Some courses may be shortened at the other end so that they do not reach the cuff 117 of the sleeve, in order to shape the sleeve.

In general, the course variation at the shoulder end is such that courses are made, on the whole at least, longer after a course 118 immediately following the initial course and extending only along the underarm line of the garment from the cuff 117 to the armpit 114. This overall increase in the course length continues until the neck 115 is reached and thereafter the course length is decreased until the final course 119 of the sleeve 112 is knitted to extend from the cuff 117 to the armpit point 120 along the underarm line of the sleeve. The armpit points 114 and 120 are joined in the finished garment to constitute the same point.

After knitting the course 119, the needles holding loops of that course are operated to press off their loops. The knitting of a part of the garment body is then begun by knitting a course 123 at the edge of the front body panel 124 and thereafter knitting successively longer courses bringing into action inactive needles holding loops in the style line 125 created when needles are progressively taken out of action to shorten the courses of the sleeve 112. The front body panel and front body shoulder portion 126 are thus produced in the direction of the arrow B in FIG. 10, a number of courses extending, in this portion, as far as the neck 115 being knitted before courses are shortened again to produce the style line 127. Eventually the final course 128 of the body panel 124 is knitted. The course 128 extends from the waist 129 of the garment to an armpit point 130.

Thereafter, knitting continues on the same single needle bed to form the sleve 133 and its associated sleeve shoulder portion 134 in the direction of the arrow C in FIG. 10 in the same way as the sleeve 112 is formed and finally, a rear body panel 135 and associated body shoulder portion 136 are formed in the direction of the arrow D in FIG. 10 in a similar way to the body panel 124 and shoulder portion 126.

Eventually, the body panel 135 is pressed off the needles along the line 137 below the armpit 114 leaving on the needles loops in a rear style line 138 marking an edge of the body shoulder portion 136 and intended, in the finished garment to coincide with the line 113. The needles or points still holding the original rib loops of the course 113 are now operated to place those loops on needles holding loops of the course 138 and thereafter a course joining loops along 113 and 138 is knitted, followed by, if desired, a few rows of knitting to prevent the joining course unravelling. The blank is then pressed off the knitting machine.

To make the blank into a garment, the neck opening is shaped and trimmed and the body panels are seamed together along lines 123/137 and 128/139 and the sleeves are seamed together along the underarm lines 111/119 and 140/141. The location of these seam lines entails the performance of only two seaming operations to close them.

In FIG. 10 shows the order of knitting is first the sleeve panel 112 followed in sequence by the body panel 124, the sleeve panel 133 and the body panel 135. The "yoke" of the garment, comprising the shoulder portions above the armpits, is knitted in the shape of a continuous piece of fabric finally joined to make a seamless frustum of a cone.

It is also possible to make the joins along the underarm lines of the sleeves during the knitting procedure by transferring the held loops along lines 111 and 140 to the needles holding loops along line 119 and 141, respectively (each at the appropriate stage in the knitting). In each case a few courses of knitting are formed after the transfer to complete the join before casting off the loops along the joined lines.

What is claimed is:

1. A method knitting on a knitting machine a blank for a sleeved garment, the method comprising the steps of (1) knitting fabric for one sleeve and for an associated sleeve shoulder portion for a yoke for the garment, so that knitted courses extend lengthwise of said sleeve fabric and through said associated sleeve shoulder portion towards the neck of the garment, (2) knitting front and rear body fabrics and associated front and rear body shoulder portions for said yoke, so that knitted courses extend in the waist-neck direction in said body fabrics and continue toward the garment neck through said body shoulder portions, and (3) knitting fabric for the other sleeve of the garment and for an associated sleeve shoulder portion for the garment yoke, so that knitted courses extend lengthwise of the sleeve fabric and through the associated sleeve shoulder portion towards the garment neck, whereby said garment yoke comprises front and rear fabrics, each of said fabrics comprising a body shoulder portion and a part of each of said sleeve shoulder portions, and wherein wales extend in the direction around the yoke, said method also including the step of, (4) shaping said yoke by knitting some courses thereof shorter than the longest courses thereof so that the shorter courses do not extend completely to the neck of the garment.

2. A method as claimed in claim 1 including the step of joining loops of an initial course of said yoke, on the knitting machine, with a final course of the yoke so that the blank falls from the knitting machine having a conical piece of yoke fabric.

3. A method as claimed in claim 1 including the steps of commencing knitting along the outer edge of a sleeve, continuing knitting on two needle beds to form on each needle bed a part of said sleeve and part of the shoulder portion associated with said sleeve, further continuing knitting on said two needle beds to form on each needle bed part of said body fabric of the garment and a body shoulder portion associated with said body fabric; and further continuing knitting on said two needle beds to form on each needle bed a part of the second sleeve of the garment and part of the shoulder portion associated with said second sleeve.

4. A method as claimed in claim 1 including the steps of knitting on needles of one needle bed a first sleeve and an associated sleeve shoulder portion of the garment, knitting on needles of each of two needle beds a distinct part of the body fabric of the garment and a distinct part of a body shoulder portion associated with said distinct part of the body fabric, and subsequently knitting on needles of one needle bed a second sleeve and an associated sleeve shoulder portion of the garment.

5. A method as claimed in claim 1 including the steps of knitting a first sleeve and an associated sleeve shoulder portion of the garment; forming at the cuff of the sleeve an area of rib fabric on two needle beds; then knitting a body part of the garment and an asociated body shoulder portion integral with said sleeve shoulder portion, said body part having adjacent the waist line of the garment an area of rib fabric knitted on two needle beds; knitting a second body part of the garment and an associated body shoulder portion integral with said sleeve shoulder portion, said second body part having adjacent the waist line of the garment an area of rib fabric knitted on two needle beds; and knitting a second sleeve and an associated sleeve shoulder portion of the garment and forming at the cuff of the sleeve an area of rib fabric on two needle beds.

6. A method as claimed in claim 1 including the steps of commencing knitting with opposed rows of loops on opposed sets of loop handling elements, said rows of loops extending from the waist into a shoulder portion of the garment; holding loops of one of said rows of loops in said shoulder portion on the associated set of loop handling elements; knitting on the opposed set of loop handling elements a sleeve and an associated sleeve shoulder portion of the garment, a body part of the garment and an associated body shoulder portion, a second sleeve and associated sleeve shoulder portion, and a second body part and associated body shoulder portion, the body and sleeve shoulder portions being knitted integrally with and in continuation of one another; and operating said opposed sets of loop handing elements to join the final part of the last garment shoulder portion to the initial row of held shoulder portion loops.

* * * * *